US005454259A

United States Patent [19]

Ishii et al.

[11] Patent Number: 5,454,259

[45] Date of Patent: Oct. 3, 1995

[54] FAILURE DETECTING APPARATUS IN TEMPERATURE CONTROLLER OF AIR-FUEL RATIO SENSOR

[75] Inventors: Satoshi Ishii, Toyota; Takao Akatsuka, Aichi, both of Japan

[73] Assignee: Toyota Jidosha Kabushiki Kaisha, Aichi, Japan

[21] Appl. No.: 282,638

[22] Filed: Jul. 29, 1994

[30] Foreign Application Priority Data

Aug. 2, 1993 [JP] Japan ..... 5-191431
Sep. 13, 1993 [JP] Japan ..... 5-227485

[51] Int. Cl.[6] ..... F02M 31/135

[52] U.S. Cl. ..... 73/118.1; 73/23.32

[58] Field of Search ..... 73/1 G, 27.32, 73/118.1

[56] References Cited

U.S. PATENT DOCUMENTS

| | | | |
|---|---|---|---|
| 4,150,562 | 4/1979 | Nielsen | 73/23.32 |
| 4,344,317 | 8/1982 | Hattori et al. | 73/23.32 |
| 4,348,732 | 9/1982 | Kreft | 73/1 G |
| 4,389,881 | 6/1983 | Butler et al. | 73/1 G |
| 4,535,316 | 8/1985 | Wertheimer et al. | 73/23.32 |
| 4,561,402 | 12/1985 | Nakano et al. | 73/23.32 |
| 4,611,562 | 9/1986 | Nakano et al. | 73/23.32 |
| 4,715,343 | 12/1987 | Kinoshita | 73/23.32 |
| 4,803,866 | 2/1989 | Miki et al. | 73/23.32 |
| 4,938,196 | 7/1990 | Hoshi et al. | 73/23.32 |
| 4,993,392 | 2/1991 | Tanaka et al. | 73/23.32 |
| 5,218,946 | 6/1993 | Wild et al. . | |
| 5,245,979 | 9/1993 | Pursiful et al. . | |
| 5,279,145 | 1/1994 | Suzuki | 73/23.32 |
| 5,285,762 | 2/1994 | Werner et al. . | |
| 5,327,780 | 7/1994 | Entenmann et al. | 73/118.1 |

FOREIGN PATENT DOCUMENTS

| | | |
|---|---|---|
| 62-44272 U | 3/1987 | Japan . |
| 4-69565 | 3/1992 | Japan . |
| 5-195843 | 8/1993 | Japan . |

*Primary Examiner*—Richard E. Chilcot, Jr.
*Assistant Examiner*—Eric S. McCall
*Attorney, Agent, or Firm*—Oliff & Berridge

[57] ABSTRACT

A plurality of air-fuel ratio sensors having a temperature characteristic are disposed in an exhaust passage in an engine, with heaters respectively provided in the sensors. The heaters generate heat when energized. An electronic control unit controls the energization of each heater in accordance with the driving conditions of the engine and the temperature condition of the exhaust passage, thereby controlling the amount of generated heat of each heater. As a result, the temperature of each sensor is controlled. When driving conditions allow an interruption to the energization of the individual heaters, the electronic control unit forcibly stops the energization of all the heaters for a predetermined period of time regardless of the energizing status of each heater. Thereafter, the electronic control unit restarts the energization of the heaters one after another, compares the value of the current flowing through each heater in the energizing state with a reference value, and determines the deterioration of the performance of each heater based on the comparison result.

19 Claims, 10 Drawing Sheets determine temperature condition and set τ based on NE, Q, THA and THW
900
forcibly energize only first heater
702
Ix<τ?
703
YES
NO
704
H1XC←1
forcibly energize only second heater
705
Ix<τ?
706
YES
NO
707
H2XC←1
forcibly energize only third heater
708
Ix<τ?
709
YES
NO
710
H3XC←1
forcibly energize only fourth heater
711
Ix<τ?
712
YES
NO
713
H4XC←1

FAILURE DETECTING APPARATUS IN TEMPERATURE CONTROLLER OF AIR-FUEL RATIO SENSOR

BACKGROUND OF THE INVENTION

1. Field of the Invention

The present invention relates generally to an air-fuel ratio sensor that detects the air-fuel ratio of an engine. More particularly, this invention relates to a diagnostic apparatus that provides optimal air-fuel ratio control by detecting for failures which may occur in a temperature controller and heater circuit used to stabilize the temperature of the air-fuel ratio sensor.

2. Description of the Related Art

In the conventional motor vehicle engine arts, it is common to control the air-fuel ratio in order to optimize engine operating characteristics under various driving conditions. Such characteristics include the engine's output performance, exhaust content, and overall vehicle driveability. The air-fuel ratio control adjusts the amount of fuel supplied to the engine in accordance with the engine speed, the particular engine load, the warm-up status or the like in order to match the actual air-fuel ratio with a target value. An air-fuel ratio sensor, provided in the exhaust passage of the engine, is used as a component in this control to detect the actual air-fuel ratio.

An oxygen sensor is a typical air-fuel ratio sensor. One type of oxygen sensor is equipped with a heater 91 as shown in FIG. 9. This oxygen sensor uses an element 93, attached to a metal housing 92. The element 93 is shaped like a test tube, with the heater 91 disposed inside. A protection cover 94 covers the element 93. The element 93 can be made of annealed zirconia or titania and its outer surface is coated with porous platinum. The inner and outer surfaces of the element 93 are electrodes 95 and 96, respectively. Due to the exposure of the outer surface of the element 93 to the exhaust gas, a voltage is generated between both electrodes 95 and 96 in accordance with the oxygen density in this gas. This voltage is output from the oxygen sensor as a measure of the oxygen density.

The output characteristic of the element 93 depends in large part on the temperature of the exhaust gas. The element 93, when activated at a predetermined temperature, exhibits a stable output characteristic. The temperature of the exhaust gas around the sensor, however, varies depending on the particular driving condition of the engine as well as the location of the sensor in the exhaust passage. The oxygen sensor equipped heater 91 provides a way to compensate the output of the element 93 under various temperature conditions. The heater in this way maintains the temperature of the element 93 at a predetermined level.

In this type of heater-equipped air-fuel ratio sensor, the element temperature is optimally maintained by controlling the energization of the heater through an electric circuit.

The aforementioned temperature controller includes a heater and a wire harness connected to the heater. When this controller is used beyond its intended serviceability, however, it becomes prone to fail and may experience an electrical or mechanical disconnection. The conventional temperature controller is however provided with no means for detecting this type of failure. If the temperature controller does fail, the air-fuel ratio continues to be detected on the erroneous assumption that the temperature of the element is being optimally controlled. Consequently, the air-fuel ratio obtained from the control of the air-fuel ratio sensor may deviate from its target value, and ultimately deteriorate the exhaust emission of the engine.

One solution to the above described shortcoming is proposed in Japanese Unexamined Utility Model Publication No. 62- 44272. This publication proposes an apparatus having a heater equipped air-fuel ratio sensor that can detect disconnections made in the temperature controller. The design of this detecting apparatus however utilizes a single air-fuel ratio sensor provided in the exhaust passage.

In this detecting apparatus, as shown in FIG. 10, a single heater 101, provided with the air-fuel ratio sensor, is connected in series to a driver 102. The heater 101, air-fuel ratio sensor and driver 102 form a heater energizing circuit. The driver 102 comprises a pair of Darlington-connected power transistors 103 and 104 and a plurality of resistors 105,106, 107, 108 and 109. An electronic control unit (not shown) inputs a control signal to an input terminal 111 of the driver 102. A battery (not shown) is connected to a power terminal 112 of the driver 102 so that the driver 102 and the heater 101 are connected in series to the battery. Depending on the engine's operating condition at any given time, as well as on the location of the air-fuel ratio sensor, the electronic control unit controls the driver 102 and the power supply to the heater 101 from the battery. The electronic control unit thus adjusts the element temperature of the air-fuel ratio sensor.

The above electric circuit incorporates a disconnection detector 113 responsive primarily to disconnections in the heater energizing circuit. This detector 113 comprises one comparator 114, two resistors 115 and 116 and a capacitor 117. One of the resistors, 115, is connected in series to the battery via the driver 102. The voltage drop across the resistor 115 is compared with a predetermined reference value by the comparator 114. When no voltage drop occurs across the resistor 115, a voltage of a predetermined level is output from an output terminal 118 of the detector 113. When engine conditions warrant the energization of heater 101, a predetermined voltage signal is output from the output terminal 118 of the detector 113. This allows the electronic control unit to determine that a disconnection exists in the heater energizing circuit. Following this, the electronic control unit outputs a signal energizing an alarm light inside the vehicle. This informs the driver of the disconnection existing in the heater energizing circuit.

The above disconnection detecting apparatus is designed to be used in an engine system that is equipped with just one air-fuel ratio sensor. If such an apparatus were to be used with a plurality of air-fuel ratio sensors, separate heater energizing circuits to would be needed to energize the heaters in the individual sensors. Each heater energizing circuit would in turn require a disconnection detector 113.

In a V shaped engine system, two exhaust passages may be provided in association with both banks of the engine. In such engines, a heater-equipped air-fuel ratio sensor would be provided in each exhaust passage. Alternatively, heater-equipped air-fuel ratio sensors could be provided at the upstream and downstream sides of a catalytic converter provided in an exhaust passage. In either case, a separate disconnection detector 113 would be required for each heater energizing circuit. The resultant design and overall structure of the disconnection detecting apparatus as described involves far too many component parts, is overly complex and impractical.

As mentioned above, the disconnection detector 113 functions mainly to detect whether disconnections exist in the heater energizing circuit. Such an apparatus, however, is not designed to detect failures other than such disconnections, e.g., performance degradation to the heater 101. Generally speaking, the heater wires or elements increasingly become thinner over long periods of service due to thermal deterioration or the like. Naturally, this degrades the heater's performance over time. Consequently, it would be desirable to detect the impaired performance of the heater 101 in order to allow its replacement when necessary.

One way to detect for deteriorations in the heater's performance is to control the current and temperature of the heater. To explain this, reference is made to the graph in FIG. 11 illustrating the relation between the heater's temperature and the current flowing through the heater (heater current). In this graph, the solid line characterizes a properly functioning heater, while the broken line characterizes a deteriorated heater. It is apparent from this graph that the heater current decreases as the heater temperature rises. This is due to the increasing resistance of the heater as the heater temperature rises.

When the diameter of the heater decreases due to thermal deterioration, the resistance of the heater increases while the amount of heater current decreases. This is illustrated in FIG. 11 by the change in the heater's characteristic from the solid to broken line. Such a deterioration in the heater's performance can be detected by determining the value of the heater current at a certain heater temperature. In consideration of the variously produced and manufactured heaters, as well as the difference in heater temperatures at the time the heater is energized, diminishing heater efficiency or heater degradation may be detected in the following manner.

A reference value must be set to allow for a comparison with the value of the heater current. This reference value is often set to a relatively low level (e.g., 0.1 A) as indicated by a lower alternate long and short dash line L in FIG. 11. In such a case, however, the range over which deteriorated heater performance can be detected narrows considerably with increasing heater temperatures. Moreover, the current value is limited to a relative small range (e.g., 0.1 to 0.2 A). This degrades the precision with which heater performance can be detected. To more accurately detect the deterioration in heater performance based on the value of the heater current, the reference value for comparison should be set to a relatively high level (e.g., 0.2 A) as indicated by an upper alternate long and short dash line H shown in FIG. 11. This would eliminate the effects or influence of the increased heater temperature on the detection process.

To accurately detect reductions in heater performance, without setting the reference value disadvantageously low, the heater may be temporarily deactivated during those periods of time when heater control is undertaken. This would allow the values for the heater's current and voltage to be determined at a time when the heater temperature are low.

With this method, however, when the engine is actually undergoing the air-fuel ratio control, the heater can only occasionally be deactivated. This effectively reduces the number of times which the conventional air-fuel ratio control operates to detect deteriorated heater performance. Moreover, the validity of this method is suspect due to the fact that actual heater performance control or detection may not be performed for long periods of time.

SUMMARY OF THE INVENTION

Accordingly, it is a primary objective of the present invention to provide a failure detecting apparatus which incorporates a single circuit to detect failures in a plurality of heaters in a temperature controller for a plurality of heater-equipped air-fuel ratio sensors.

It is another objective of this invention to provide a failure detecting apparatus which can determine which one of a plurality of heaters in a temperature controller, having a plurality of heater-equipped air-fuel ratio sensors, has failed.

It is a further objective of this invention to provide a failure detecting apparatus that can frequently and precisely detect deterioration in the performance of at least one heater in a temperature controller using at least one heater-equipped air-fuel ratio sensor.

It is still a further objective of this invention to provide a failure detecting apparatus which can detect the deterioration in the performance of at least one heater in a temperature controller using at least one heater-equipped air-fuel ratio sensor at higher level of precision without being influenced by the temperature of the heater itself.

To achieve the foregoing and other objects and in accordance with the purpose of the present invention, a failure detecting apparatus in a temperature controller is proposed. The apparatus has an electric heater which is provided in an air-fuel ratio sensor disposed in an exhaust passage in an engine, said sensor being arranged to be activated when being heated up to a predetermined temperature. The apparatus is arranged to adjust an amount of heat generated by said heater to control a temperature of said sensor by selectively energizing and deenergizing said heater with an electric power from a power supply in accordance with driving conditions of the engine and a temperature condition in the exhaust passage. The apparatus comprises a first detecting device for detecting a driving status of the engine, a second detecting device for detecting a selected one from a group consisting of a current magnitude in the heater and a voltage value associated with said heater, and a first control device storing data indicative of predetermined driving conditions of the engine under which the temperature controller is to be diagnosed. The control device forcibly deenergizes the heater for a predetermined period of time when the driving status detected by the first detecting device meets with the predetermined driving conditions. The apparatus further includes a first failure determining device for energizing said heater after said heater has been deenergized by said first control device, and determining an occurrence of a failure associated with said heater based on a detection result of said second detecting device.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIGS. 1 through 7 illustrate a failure detecting apparatus in a temperature controller for an air-fuel ratio sensor according to a first embodiment of the present invention.

FIG. 1 is a schematic structural diagram illustrating a V shape gasoline engine system;

FIG. 2 is a block diagram showing the electric structure of an electronic control unit (ECU);

FIG. 3 is an electric circuit diagram showing heater energizing circuits including individual heaters, a driver, a current detector, a voltage detector, etc.;

FIG. 4 is a flowchart illustrating a control routine that is executed by the ECU to control the temperature of an air-fuel ratio sensor and detect a failure in a heater;

FIG. 5 is a detailed flowchart illustrating a part of the flowchart in FIG. 4;

FIG. 6 is a detailed flowchart illustrating a part of the flowchart in FIG. 4; and FIG. 7 is a detailed flowchart illustrating a part of the flowchart in FIG. 4.

DETAILED DESCRIPTION OF THE PREFERRED EMBODIMENTS

First and second embodiments of the present invention will now be described. Since the fundamental structure of a gasoline engine system for a vehicle is common to both embodiments, this structure will be discussed in detail only with the first embodiment. The second embodiment according to the present invention will be described in terms of the differences existing between the first and second embodiments.

First Embodiment

A failure detecting apparatus in a temperature controller for an air-fuel ratio sensor according to the first embodiment will be described in detail with reference to FIGS. 1 through 7.

Figure 1:
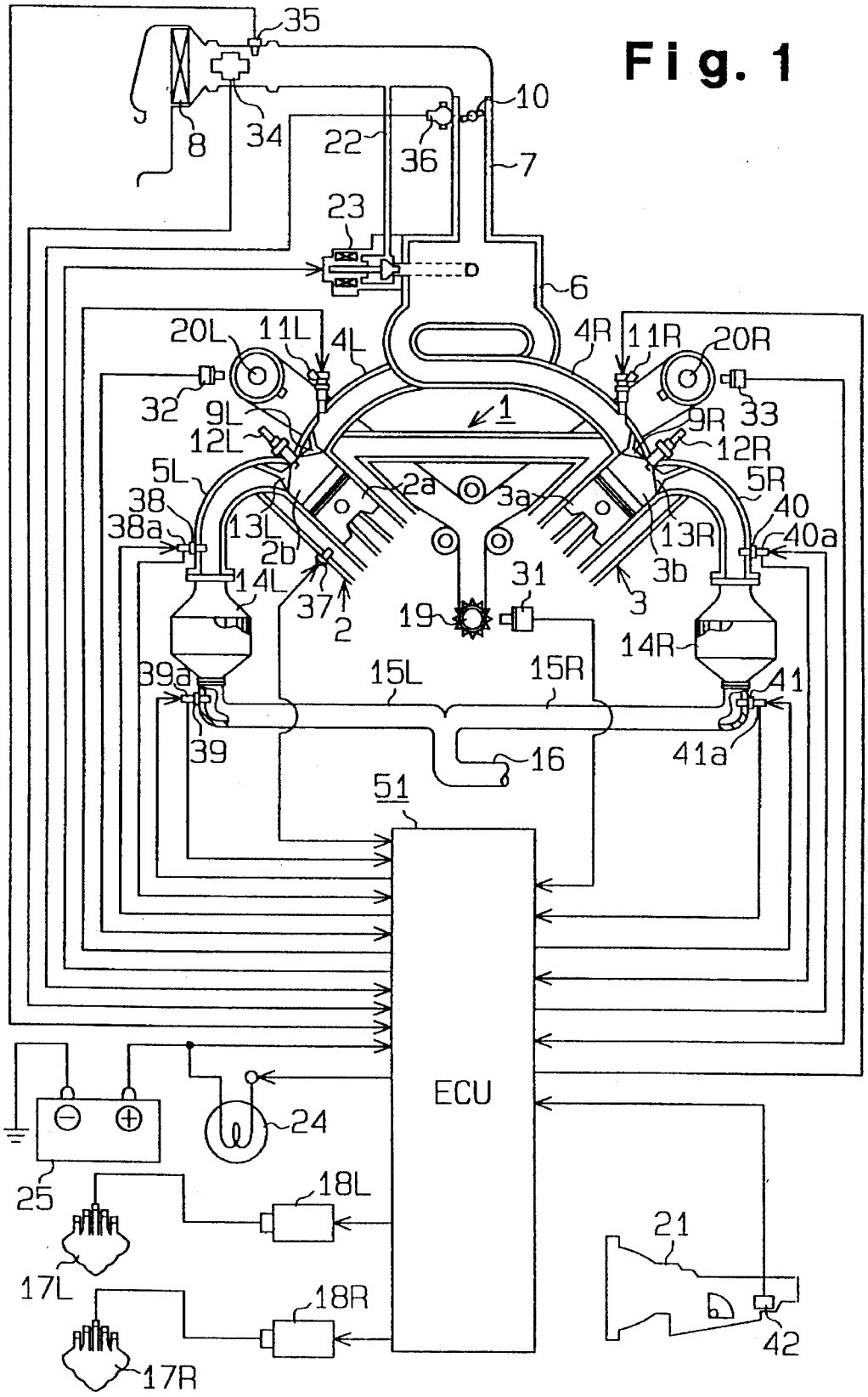

FIG. 1 presents a schematic structural diagram showing a V shape gasoline engine system mounted in a vehicle. An engine body 1 has a left bank 2 and a right bank 3, each of which is provided with the same number of cylinders. A piston 2*a* is reciprocatably provided in each associated cylinder with a combustion chamber 2*b* formed therein. Likewise, a piston 3*a* is reciprocatably provided in each associated cylinder with a combustion chamber 3*b* formed therein. Intake manifolds 4L and 4R and exhaust manifolds 5L and 5R, connected to the banks 2 and 3, respectively, communicate with the respective combustion chambers 2*b* and 3*b*.

The intake manifolds 4L and 4R are connected to a common surge tank 6 and a common air-intake pipe 7. An air cleaner 8 is provided on the inlet side of the air-intake pipe 7. Those components 4L, 4R, 6 and 7 constitute an air-intake passage. Outside air taken into the air-intake pipe from the air cleaner 8 is guided through the surge tank 6 to the individual intake manifolds 4L and 4R. As the pistons 2*a* and 3*a* move downward, the air is then fed into the individual combustion chambers 2*b* and 3*b* via intake valves 9L and 9R respectively 2*b* and 3*b*.

The amount of intake air, Q, supplied to each combustion chamber 2*b* or 3*b* is controlled by a throttle valve 10 provided in the air-intake pipe 7. The throttle valve 10 functions in response to the manipulation of an accelerator pedal (not shown). Fuel injectors 11L and 11R are respectively provided in the intake manifolds 4L and 4R in association with the respective cylinders. Ignition plugs 12L and 12R are provided in the respective banks 2 and 3 in association with the respective cylinders. It is well known that when the injectors 11L and 11R are energized open, fuel is fed under pressure from a fuel tank by a fuel pump (both not shown) and injected in the intake manifolds 4L and 4R. The injected fuel is mixed with air, and this air-fuel mixture is supplied to each combustion chamber 2*b* or 3*b*. In the combustion chambers 2*b* and 3*b*, the supplied air-fuel mixtures are burned by the ignition plugs 12L and 12R, respectively.

As the pistons 2*a* and 3*a* move upward, respectively opening exhaust valves 13L and 13R, burnt exhaust gases are vented from the combustion chambers 2*b* and 3*b* to the exhaust manifolds 5L and 5R that form an exhaust passage. To vent the supplied exhaust gases and to reduce the amount of exhaust pollutants entering the atmosphere, catalytic converters 14L and 14R each having catalytic converter rhodium are respectively connected to the exhaust manifolds 5L and 5R. Exhaust pipes 15L and 15R are respectively connected to the downstream sides of the catalytic converters 14L and 14R. Both pipes 15L and 15R also connect to a common exhaust pipe 16. It is known that the action of each of the catalytic converters 14L and 14R oxidize hydrocarbon (HC) and carbon monoxide (CO) and reduce the nitrogen oxide (NOx), in the exhaust gas.

Ignition signals distributed by separate distributors 17L and 17R are applied to the associated ignition plugs 12L and 12R. The distributors 17L and 17R distribute high voltages, output from separate igniters 18L and 18R, to the ignition plugs 12L and 12R in synchronism with the rotation of a crankshaft 19 in the engine body 1. The ignition timings for the ignition plugs 12L and 12R are determined by the output timings of the high voltages from the igniters 18L and 18R.

The engine body 1 is provided with an engine speed sensor 31 which detects the rotational speed of the crankshaft 19 as engine speed NE. The banks 2 and 3 are respectively provided with first and second engine timing sensors 32 and 33 which detect the reference positions G1 and G2 as in a change in the rotational angle of the crankshaft 19 (crank angle). Position G1 and G2 correspond to top dead centers of the pistons 2*b* and 3*b*, based on the rotations of cam shafts 20L and 20R both of which are interlocked with the crankshaft 19.

An air flow meter 34 is attached to the downstream side of the air cleaner 8. This meter 34 detects the amount of intake air Q supplied to each combustion chamber 2*b* or 3*b* via the air-intake pipe 7, etc. An air temperature sensor 35, provided in the vicinity of the air flow meter 34, detects the temperature of air, THA, led into the air-intake pipe 7 (intake air temperature). A throttle sensor 36, provided in the vicinity of the throttle valve 10, detects the angle of the throttle valve 10 (throttle angle) TA. In addition, a coolant temperature sensor 37 is attached to the engine body 1. This sensor 37 detects the temperature of the coolant, THW, in the engine body 1.

Figure 9:
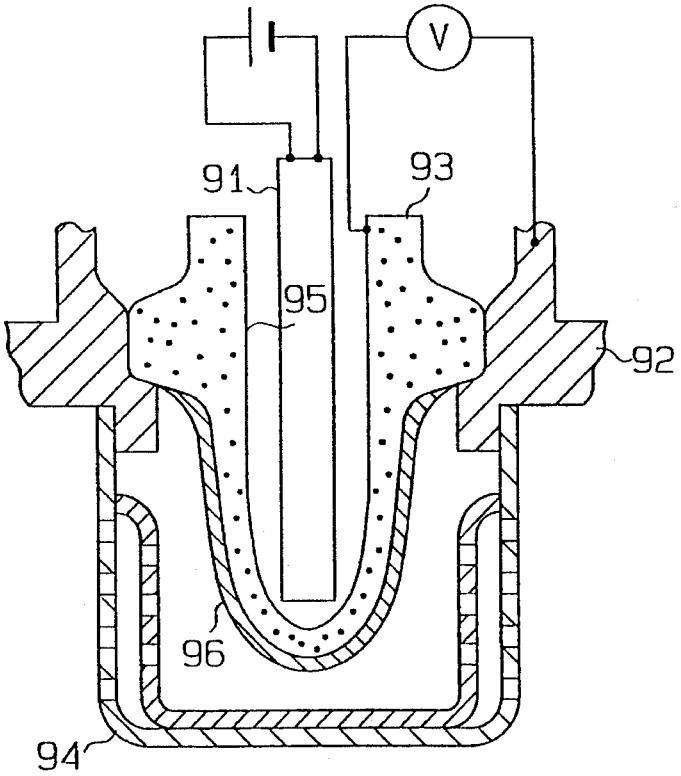
FIG. 9 is a cross-sectional view showing the structure of a typical heater-equipped oxygen sensor.
Figure 10:
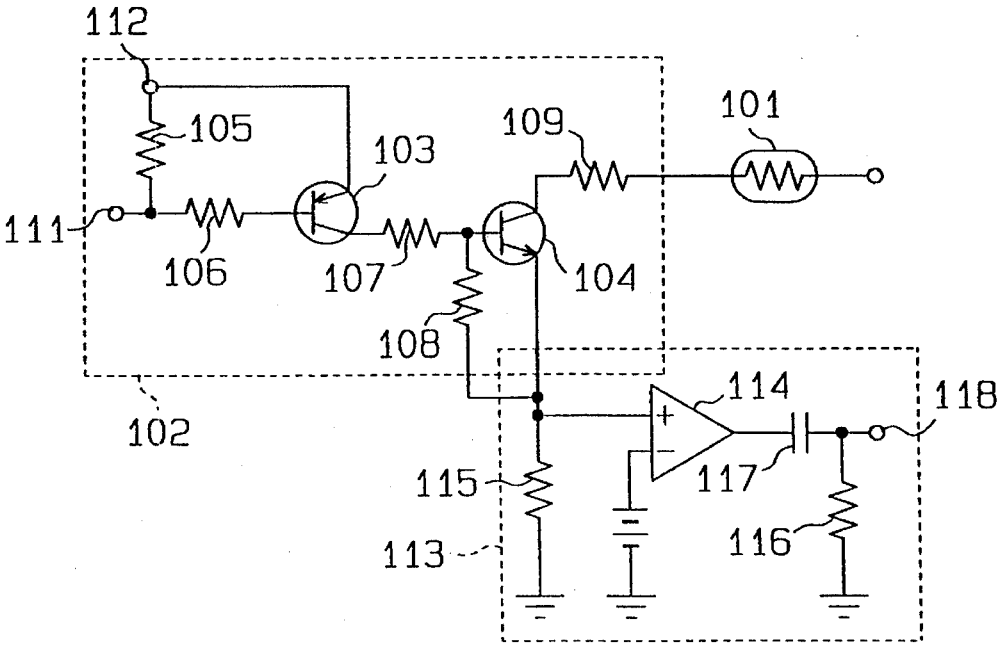
Fig. 10 (PRIOR ART)
FIG. 10 is an electric circuit diagram showing a apparatus for detecting disconnections in a heater having a conventional air-fuel ratio sensor.
Figure 11:
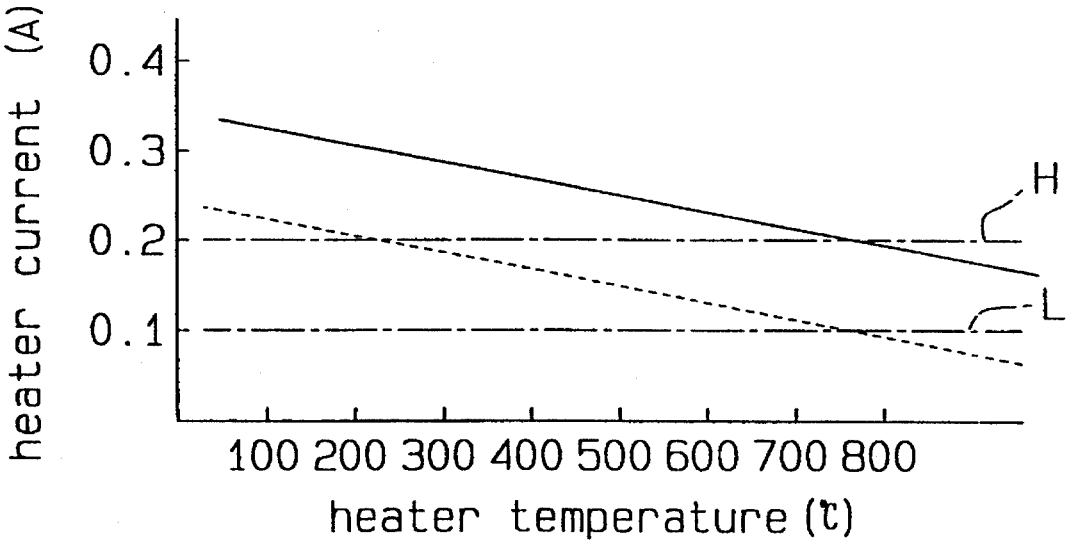
FIG. 11 is a graph showing the heater temperature vs. heater current characteristics of heaters.

First and second oxygen sensors 38 and 39 are respectively attached to the upstream side and downstream side of one of the catalytic converters, 14L, in the exhaust passage. Likewise, third and fourth oxygen sensors 40 and 41 are respectively attached to the upstream side and downstream side of the other catalytic converters 14R. Those sensors 38 to 41 each detect the density of oxygen Ox in the exhaust gas. The sensors 38 to 41 have the same structure as the conventional oxygen sensor which has been explained earlier with reference to FIG. 9, and each has an element having a predetermined temperature characteristic to sense the oxygen density. The oxygen sensors 38 to 41 are respectively provided with first to fourth heaters 38*a*, 39*a*, 40*a* and 41*a* which generate heat to adjust the temperatures of the elements when energized.

A transmission 21 coupled to the engine body 1 is provided with a vehicle speed sensor 42 which detects the speed of the vehicle (vehicle speed) SPD. A bypass passage 22, provided in the intake passage, connects the air-intake pipe 7 to the surge tank 6, bypassing the throttle valve 10. Disposed in this passage 22 is a known linear solenoid type idle speed control valve (ISCV) 23. The opening amount of this ISCV 23 is controlled to stabilize the idling of the engine by which the throttle valve 10 is fully closed. This control adjusts the amount of air flowing through the bypass passage 22, thereby controlling the amounts of intake air Q supplied to the combustion chambers 2*b* and 3*b*.

An alarm lamp 24 is provided on an instrument panel (not shown) located in front of the driver's seat. One lead line of this lamp 24 is connected to the positive terminal of a battery 25 while the other lead line is grounded. When a failure in any of the heaters 38*a* to 41*a* of the oxygen sensors 38 to 41 is detected, the alarm lamp 24 is lit to inform the driver of that event.

In this embodiment, the injectors 11L and 11R, the igniters 18L and 18R, the ISCV 23, the alarm lamp 24 and the heaters 38*a* to 41*a* are controlled by an electronic control unit (ECU) 51. For this purpose, the ECU 51 receives detected values from the individual sensors 31 to 33 and 35 to 42 and the air flow meter 34. Based on those detected values, the ECU 51 executes various kinds of controls.

To properly control the amount of fuel injection in accordance with the driving conditions of the engine, the ECU 51 controls the injections 11L and 11R. The ECU 51 performs feedback control on the air-fuel ratio of the engine based on the received values from the individual oxygen sensors 38 to 41. At this time, the ECU 51 controls the heaters 38*a* to 41*a* to properly adjust the temperatures of the elements in the oxygen sensors 38 to 41. The ECU 51 determines if a failure has occurred in any of the heaters 38*a* to 41*a*, and turns on the alarm lamp 24 when detecting such a failure. The ECU 51 controls both igniters 18L and 18R to properly control the ignition timings in accordance with the driving conditions of the engine. To properly control the idling engine speed in accordance with the driving conditions of the engine, the ECU 51 controls the ISCV 23.

Figure 2:
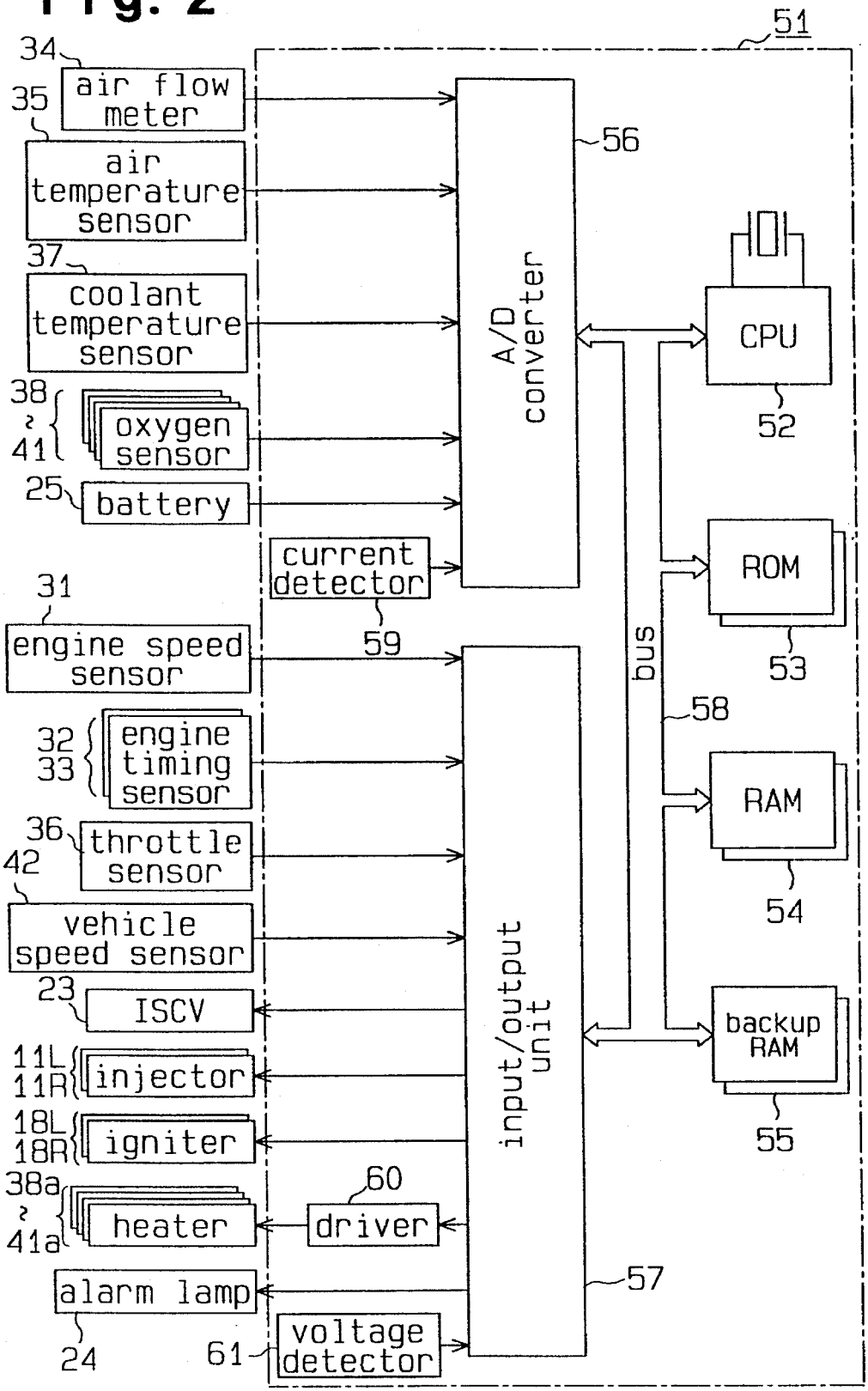

FIG. 2 is a block diagram illustrating the various electronic components of the ECU 51. The ECU 51 includes a central processing unit (CPU) 52, a read only memory (ROM) 53, a random access memory (RAM) 54, and a backup RAM 55. The ECU 51 includes an arithmetic logic unit which has those components 52 to 55, an analog/digital converter (A/D converter) 56, an input/output unit 57, etc., connected together by a bus 58. Predetermined control programs that are executed by the CPU 52 are previously stored in the ROM 53. Namely, the ROM 53 stores the control routine which will be described later. The RAM 54 temporarily stores the results of operations executed by the CPU 52. The backup RAM 55 retains previously stored data. According to this embodiment, in particular, data about failure detection is stored in the backup RAM 55. The A/D converter 56 has a multiplexer and the input/output unit 57 has a buffer.

The aforementioned air flow meter 34, sensors 35 and 37 to 41 and battery 25 are connected to the A/D converter 56. Also connected to the A/D converter 56 is a current detector 59 which will be described later. The sensors 31 to 33, 36 and 42 are connected to the input/output unit 57. Further connected to the input/output unit 57 are the aforementioned components 23, 11L, 11R, 18L, 18R and 24. The individual heaters 38*a* to 41*a* are connected via a driver 60 to the input/output unit 57. Also connected to the input/output unit 57 is a voltage detector 61 which will be described later.

The values detected by the sensors 31 to 33 and 35 to 42 as well as the air flow meter 34 are input to the CPU 52 via the A/D converter 56 and input/output unit 57. The CPU 52 also receives input both from the current detector 59 via A/D converter 56 and from the voltage detector 61 via the input/output unit 57. Based on those input values, the CPU 52 executes various processes according to predetermined control programs and outputs control signals to the components 23, 11L, 11R, 18L, 18R and 24 via the input/output unit 57. Based on those input values, likewise, the CPU 52 executes various processes according to predetermined control programs and outputs energization signals to the heaters 38*a* to 41*a* via the input/output unit 57 and the driver 60.

Figure 3:
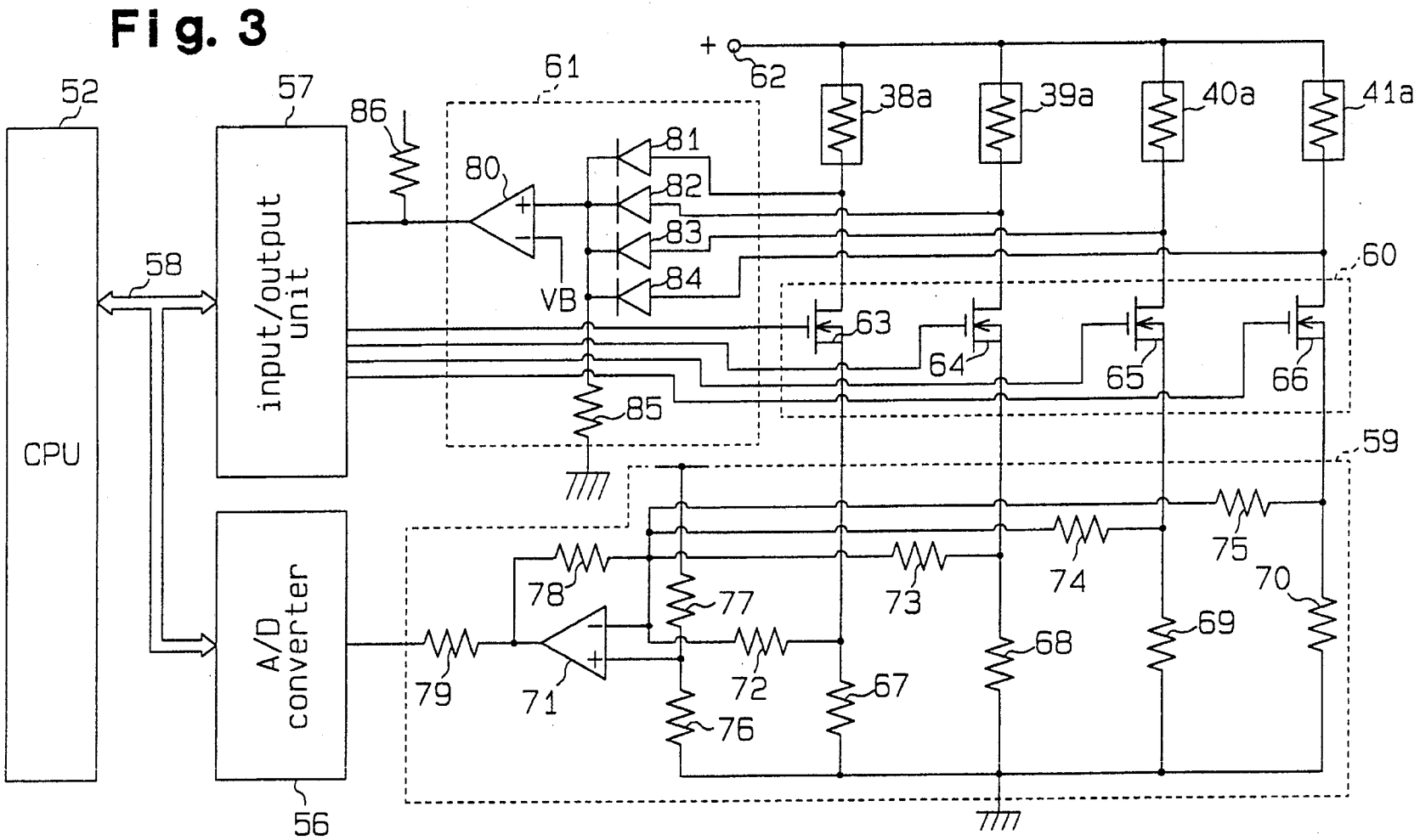

The current detector 59, driver 60 and voltage detector 61 are included in the ECU 51, and constitute a temperature controller for activating the heaters 38*a* to 41*a* in the oxygen sensors 38 to 41 and a failure detecting apparatus for detecting a failure in any of the heaters 38*a* to 41*a*. FIG. 3 presents an electric circuit diagram showing heater energizing circuits including the individual heaters 38*a* to 41*a* and the circuits for 59 to 61. In this diagram, one terminal of each of the heaters 38*a* to 41*a* is connected in parallel to the battery 25 via an input terminal 62. The circuits for 59 to 61 are connected between the other ends of the heaters 38*a* to 41*a* and the ground.

The driver 60 comprises first to fourth power MOS transistors 63, 64, 65 and 66 provided in association with the individual heaters 38*a* to 41*a*. The transistors 63 to 66 each have an input terminal connected via the input/output unit 57 to the CPU 52. The emitters of the transistors 63 to 66 are connected to the respective heaters 38*a* to 41*a*. When an instruction signal is input from the CPU 52 to the input terminals of the transistors 63 to 66, the transistors 63 to 66 are turned on. As a result, the individual heater energizing circuits are closed, energizing the heaters 38*a* to 41*a*.

The current detector 59 comprises four resistors 67 to 70, an operational amplifier 71 and eight other resistors 72 to 79. The four resistors 67 to 70 each have one terminal connected in series to the respective heaters 38*a* to 41*a* via the collectors of the transistors 63 to 66. The other terminal end of the resistors 67 to 70 are grounded. Resistors 72 to 75 each have one terminal connected between the resistors 67 to 70 and the transistors 63 to 66 respectively, and their other terminal connected to the inverting input terminal of the operational amplifier 71. The non-inverting input terminal of the operational amplifier 71 is connected between the resistors 76 and 77. The resistor 78 is connected between the inverting input terminal and the output terminal of the operational amplifier 71. The output terminal of the operational amplifier 71 is connected via the resistor 79 to the A/D converter 56.

When one of the heaters 38*a* to 41*a* is activated, the current value detected by a combination of the resistors 67 to 70 and the resistors 72 to 75 in the current detector 59 is amplified by the operational amplifier 71 and is then input to the A/D converter 56. The amplified current value is converted to a digital value in the A/D converter 56 before being input to the CPU 52. Based on the predetermined control programs stored previously in the ROM 53, the CPU 52 determines whether an abnormality in the current value exists.

In this embodiment, the CPU 52 determines the current abnormalities existing in the heater energizing circuits which includes heaters 38*a* to 41*a*, to detect an excess amount of current, the current abnormalities also represent a reduction in the performance of the heaters.

The voltage detector 61 comprises one comparator 80, four diodes 81 to 84 and one resistor 85. The anodes of the diodes 81 to 84 are connected between the heaters 38*a* to 41*a* and the transistors 63 to 66, respectively. The cathodes of the diodes 81 to 84 and one terminal of the resistor 85 are connected to the non-inverting input terminal of the comparator 80 while the other terminal of the resistor 85 is grounded. The output terminal of the comparator 80 is connected via the input/output unit 57 to the CPU 52 and is connected to one end of a resistor 86.

Of the transistors 63 to 66, output from the one having the highest emitter voltage, i.e., the transistor having the smallest voltage drop is input to the non-inverting input terminal of the comparator 80. A reference value VB which is to be compared with this voltage value is input to the inverting input terminal of the comparator 80. The comparator 80 compares the received voltage value with the reference value VB and outputs the comparison result from the output terminal to the CPU 52 via the input/output unit 57.

Based on the output of the comparator 80, the CPU 52 uses a predetermined control program to determine whether an abnormality exists in the voltage drop characteristic. In this example, when the heater 38*a* to 41*a* are energized and the sampled voltage level is relatively high in comparison with reference value VB, the output of the comparator 80 goes high. Consequently, the CPU 52 determines that an abnormality exists in the voltage drop level.

In this embodiment, the abnormality in the voltage drop is determined to detect any disconnection that may exist with respect to any of the heater energizing circuits. This includes determining whether the heaters 38*a* to 41*a* have failed.

A description will now be given of how the heaters 38*a* to 41*a* control the temperatures of the oxygen sensors 38 to 41 and of the process used for detecting a failure in any of the heaters 38*a* to 41*a*. The diagnostic apparatus of this embodiment detects not only disconnections existing in the heater circuits, but also excessive heater currents, deterioration of the heaters performance, and failures that may have occurred in any of the heater energizing circuits including the heaters 38*a* to 41*a*. The flowcharts shown in FIGS. 4 through 7 illustrate a control routine periodically executed by the ECU 51 at predetermined intervals during engine operation.

When this routine is started, at step 100, the ECU 51 reads various engine operating parameters NE, Q, TA and THW based on signals provided from the sensors 31, 36 and 37 and the air flow meter 34. The ECU 51 also reads the voltage level of the battery 25.

Next, at step 110, the ECU 51 controls the energization of the heaters 38*a* to 41*a* to adjust the element temperatures of the oxygen sensors 38 to 41. To do this, the ECU 51 determines the driving conditions of the engine based on the various parameters NE, Q, TA and THW. The ECU then determines whether these conditions correspond to energizing conditions preset for heaters 38*a* to 41*a* according to the location of the oxygen sensors 38 to 41 in the exhaust passage. When the driving conditions match the predetermined energizing conditions, the ECU 51 controls the switching of the transistors 63 to 66 in the driver 60 in a predetermined manner. The details of the control mode will not be given here. According to this switching control, the individual heater energizing circuits are utilized to control the energization of the heaters 38*a* to 41*a*. In this way, the element temperatures of the oxygen sensors 38 to 41 can be accurately controlled.

At step 200, the ECU 51 determines whether or not the heaters 38*a* to 41*a* are all energized in accordance with their respective energizing conditions. When fewer than all the heaters 38*a* to 41*a* are detected as energized, the ECU 51 determines that no discontinuity check is needed and moves to step 400. When all the heaters 38*a* to 41*a* are energized, the ECU 51 proceeds to step 210 to detect for any possible circuit disconnections.

At step 210, the ECU 51 determines whether or not the output of the comparator 80 of the voltage detector 61 is set low. When all the heaters 38*a* to 41*a* are energized, an expected voltage drop occurs in each heater energizing circuit and a low-level voltage is input to the non-inverting input terminal of the comparator 80. When this input voltage is lower than the reference value VB input to the inverting input terminal of the comparator 80, the comparator 80 outputs a low voltage level signal. Given this, the ECU 51 moves from step 210 to step 400, and assumes that no disconnection exists with respect to the heater energizing circuits including the heaters 38*a* to 41*a*. When the output of the comparator 80 is other than at a low level, the ECU 51 determines that a disconnection exists with respect to at least one of the heaters 38*a* to 41*a*. The ECU 51 then proceeds to step 300 to identify which one of the heaters 38*a* to 41*a* has a disconnection problem.

Figure 5:
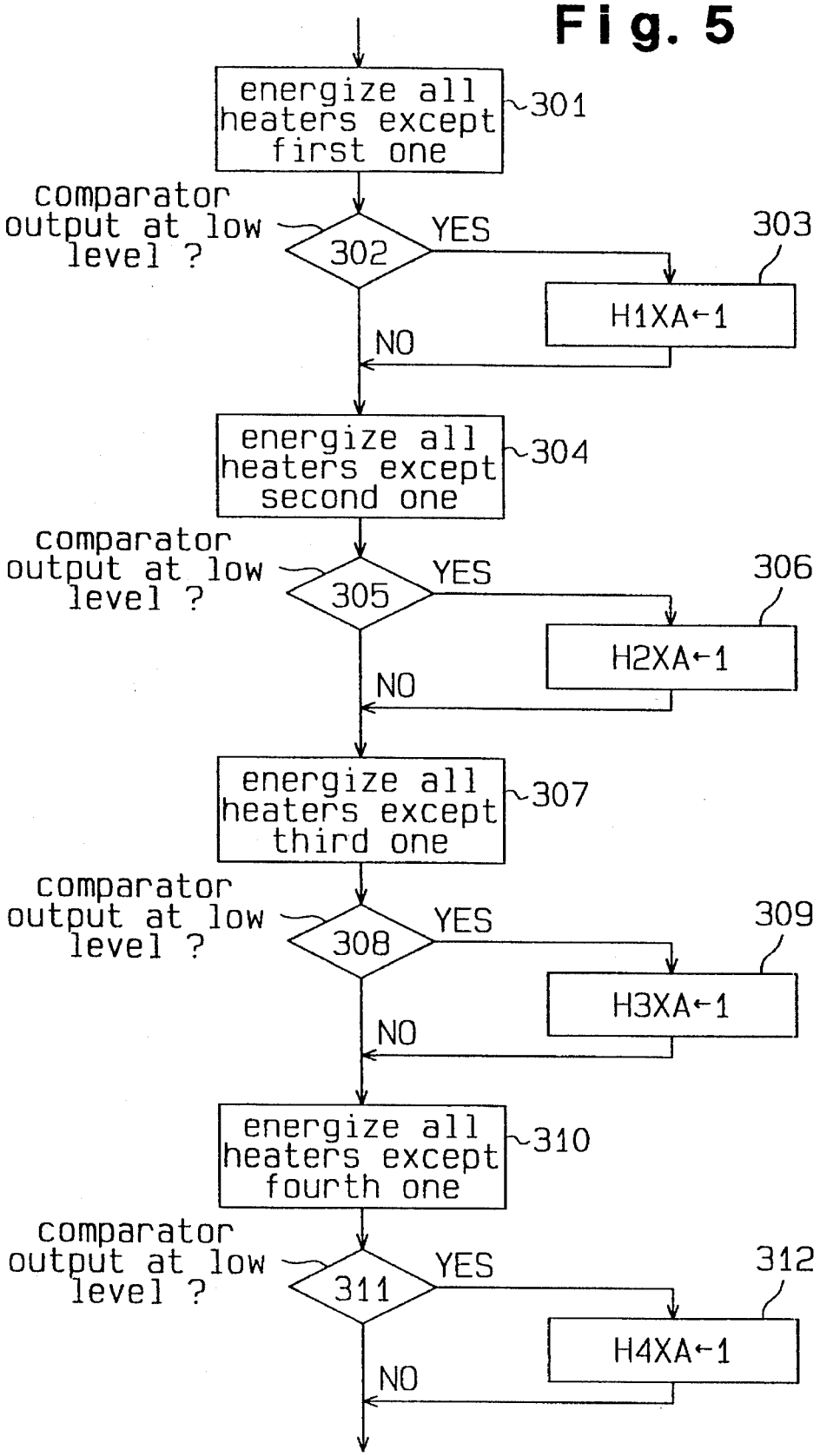

To make this identification, the ECU 51 determines an abnormality in the voltage drop in any of the heater energizing circuits including the heaters 38*a* to 41*a* at step 300. The detailed processing in this step 300 is illustrated in FIG. 5.

First at step 301, the ECU 51 controls the switching of the individual transistors 63 to 66 to energize the heaters 39*a*, 40*a* and 41*a*. Only the first heater 38*a* remains deenergizied. The ECU 51 then determines if the output of the comparator 80 is low at step 302. When the output of the comparator 80 is low, the ECU 51 proceeds to step 303, having determined that a disconnection exists with respect to the first heater 38*a*. At step 303 the ECU 51 sets a failure flag H1XA to "1" indicating the occurrence of a disconnection associated with the first heater 38*a* and then advances to step 304. On the other hand, when the output of the comparator 80 is not low, the ECU 51 proceeds to step 304 from step 302, having determined that a disconnection exists with respect to one of the heaters 39*a*, 40*a* and 41*a*.

At step 304, the ECU 51 controls the transistors 63 to 66 to energize the heaters 38*a*, 40*a* and 41*a*. Only the second heater 39*a* remains deenergized.

At step 305, the ECU 51 determines if the output of the comparator 80 is low. When the output of the comparator 80 is low, the ECU 51 proceeds to step 306, having determined that a disconnection associated with the second heater 39*a* exists. At step 306 the ECU 51 sets a failure flag H2XA to "1" which indicates that the second heater 39*a* has a disconnection associated with it. Following this, the ECU 51 proceeds to step 307. Should the output of the comparator 80 not be low at step 305, the ECU 51 proceeds to step 307, having determined that a disconnection exists with respect to the heaters 40*a* and 41*a*. At step 307, the ECU 51 controls the transistors 63 to 66 to energize the heaters 38*a*, 39*a* and 41*a*. Only the third heater 40*a* remains deenergized.

At step 308, the ECU 51 determines if the output of the comparator 80 is low. If at that time, the output of the comparator 80 is low, the ECU 51 proceeds to step 309, having determined that a disconnection exists with the respect to third heater 40*a*. At step 309, the ECU 51 sets a failure flag H3XA to "1" indicating that a disconnection exists with respect to the third heater 40*a* and advances to step 310. When the output of the comparator 80 is not low, the ECU 51 proceeds to step 310 from step 308, having determined that a disconnection exists with respect to the remaining fourth heater 41*a*.

At step 310, the ECU 51 controls the transistors 63 to 66 to energize the heaters 38*a*, 39*a* and 40*a*. Only the fourth heater 41*a* remains deenergized.

At step 311, the ECU 51 determines if the output of the comparator 80 is low. If so, the ECU 51 proceeds to step 312, having determined that a disconnection exists with respect to fourth heater 41*a*. At this step 312 the ECU 51 sets a failure flag H4XA to "1", indicating that a disconnection exists with respect to the fourth heater 41*a*. When the output of the comparator 80 is not low, the ECU 51 considers that no disconnection exists respecting any of the heaters 38*a* to 41*a* and terminates the process of detecting disconnections.

Figure 4:
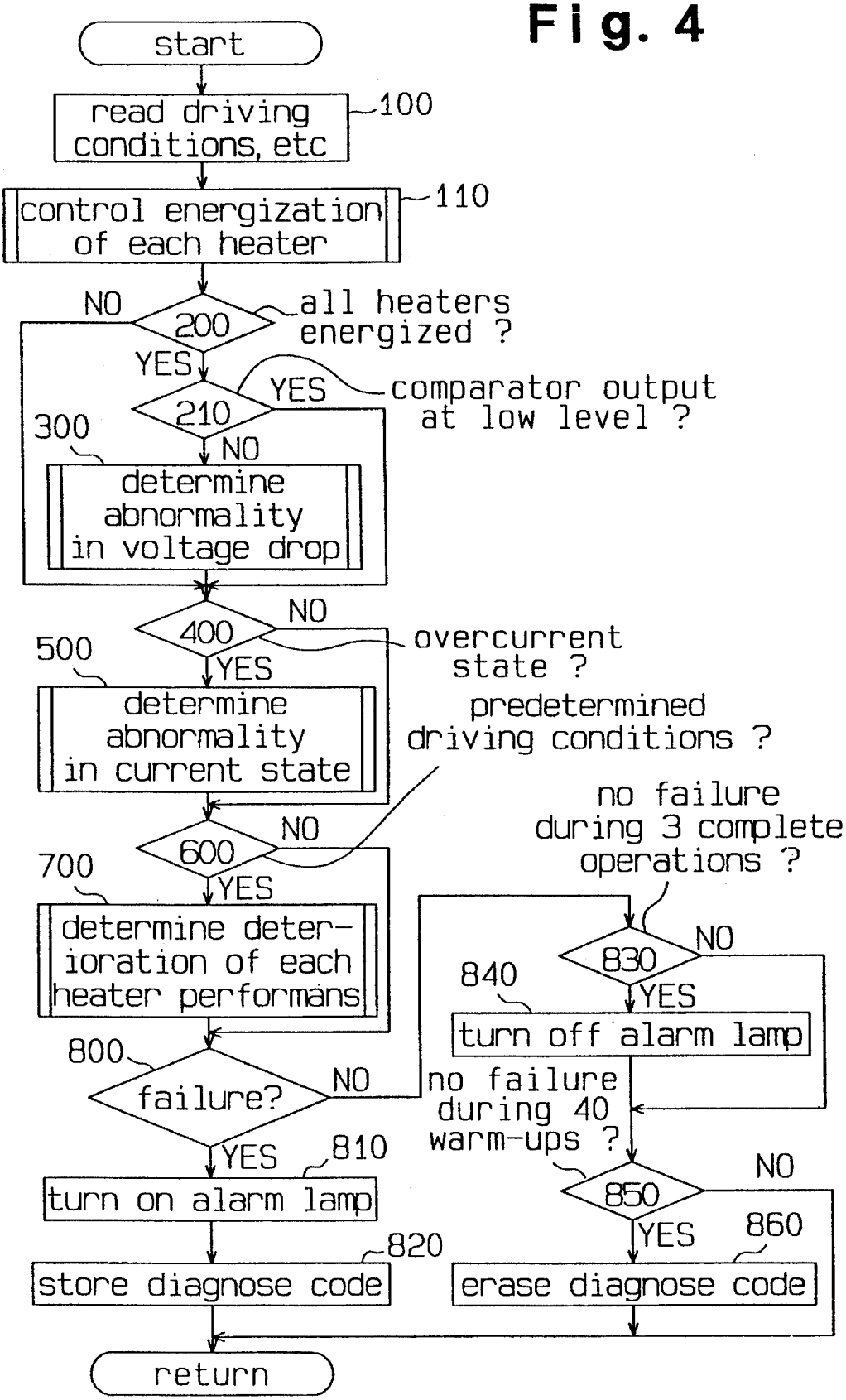

After the ECU 51 executes the process at step 300 in this manner, the ECU 51 moves to step 400 in the flowchart shown in FIG. 4.

In the flowchart in FIG. 4, after proceeding to step 400 from steps 200,210 or 300, the ECU 51 determines whether too much current (an overcurrent) is flowing through each of the heater energizing circuits including the heaters 38*a* to 41*a*. The ECU 51 makes this decision based on the output of the operational amplifier 71 of the current detector 59. The output level of the operational amplifier 71 is compared with a predetermined current value according to the number of the heaters 38*a* to 41*a* energized from time to time. An excess of current may result from the short-circuiting of the heater energizing circuits. At step 400, therefore, short-circuiting associated with each of the heaters 38*a* to 41*a* is determined.

When an overcurrent condition does not exist, the ECU 51 proceeds to step 600 from step 400 to detect for additional failures. When an overcurrent state is detected, the ECU 51 proceeds to step 500 from step 400 to specify which one of the heaters 38*a* to 41*a* is associated with that overcurrent.

Figure 6:
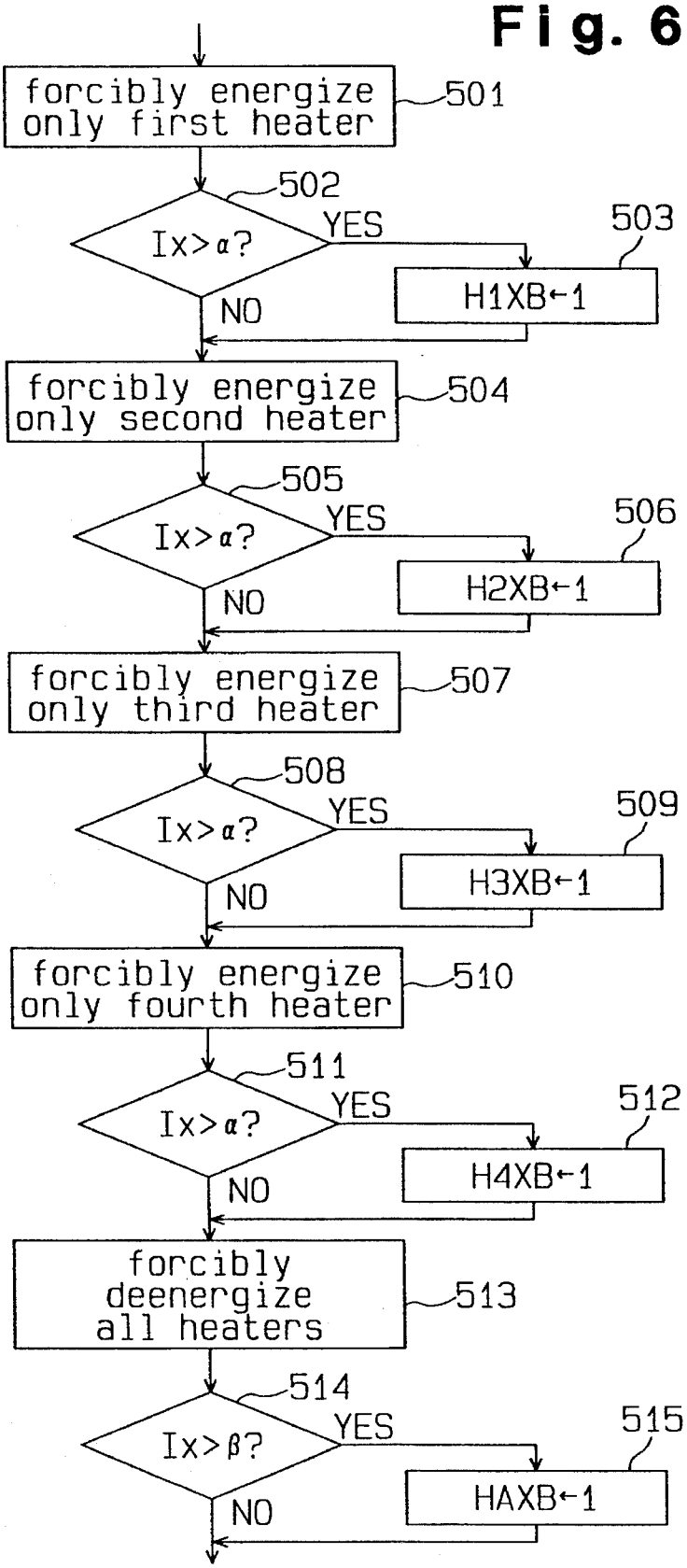
Figure 4:
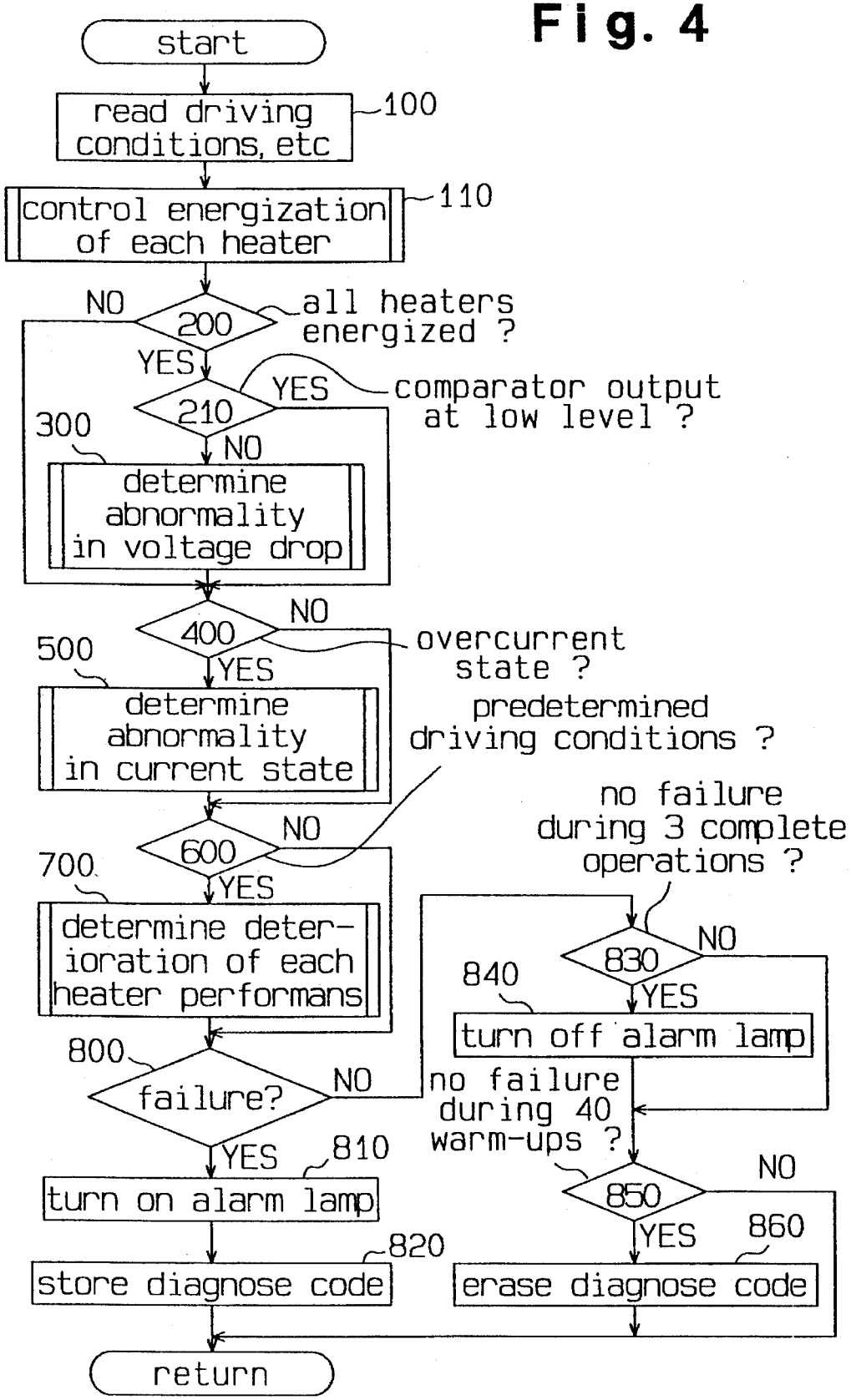

At step 500, the ECU 51 determines whether a current abnormality exists with respect to the heaters 38*a* to 41*a* and identifies which one of the heaters 38*a* to 41*a* is associated with that overcurrent. The details of the processing at step 500 are illustrated in FIG. 6.

The ECU 51 controls the transistors 63 to 66 to forcibly energize only the first heater 38*a* at step 501. Since the other heaters 39*a* to 41*a* are not energized at that time, the current value associated with the first heater 38*a* is the only input to the operation amplifier 71 of the current detector 59. This current value is output as a detected value Ix from the current detector 59 and is input to the CPU 52 via the A/D converter 56.

At step 502, the ECU 51 determines if the detected value Ix at that time is greater than a predetermined value α. When the detected value Ix is not greater than the predetermined value α, the ECU 51 considers that the heater 38*a* has no overcurrent problem and proceeds to step 504. When the detected value Ix is greater than the predetermined value α, the ECU 51 moves to step 503 where a failure flag H1XB is set to "1", indicating that an overcurrent exists with respect to the first heater 38*a*. The ECU 51 then moves to step 504 where it forcibly energizes only the second heater 39*a* by controlling the transistors 63 to 66.

At step 505, the ECU 51 determines if the detected value Ix at that time is greater than the predetermined value α. If the value Ix is not greater than the predetermined value α, the ECU 51 considers that the second heater 39*a* has no overcurrent problem and proceeds to step 507. When the detected value Ix is greater than the predetermined value α, the ECU 51 moves to step 506 where a failure flag H2XB is set to "1" indicating the overcurrent state associated with the second heater 39*a*. The ECU 51 then moves to step 507 where it forcibly energizes only the third heater 40*a* by controlling the transistors 63 to 66.

At step 508, the ECU 51 determines if the detected value Ix is greater than the predetermined value α. When the detected value Ix is not greater than the predetermined value α, the ECU 51 considers that the third heater 40*a* has no overcurrent problem and proceeds to step 510. When the detected value Ix is greater than the predetermined value α, the ECU 51 moves to step 509 where a failure flag H3XB is set to "1" indicating the existence of an overcurrent associated with the third heater 40*a*. The ECU 51 then moves to step 510 when it forcibly energizes the fourth heater 41*a* alone by controlling the transistors 63 to 66.

At step 511, the ECU 51 determines if the detected value Ix is greater than the predetermined value α. When the detected value Ix is not greater than the predetermined value α, the ECU 51 considers that an overcurrent state does not exist with respect to the fourth heater 41*a* and proceeds to step 513. When the detected value Ix is greater than the predetermined value α, the ECU 51 moves to step 512 where a failure flag H4XB is set to "1" indicating the existence of an overcurrent with respect to the fourth heater 41*a*. The ECU 51 then moves to step 513, where it forcibly stops energizing all the heaters 38*a* to 41*a* by controlling the transistors 63 to 66.

At step 514, the ECU 51 determines if the detected value Ix is greater than a predetermined value β (β<α). If value Ix is not greater than the value β, the ECU 51 considers that no overcurrent exist with respect to any of the heaters 38*a* to 41*a* and terminates the process of detecting for an overcurrent. However, when the detected value Ix is greater than the predetermined value β, the ECU 51 determines that an overcurrent exists with respect to all the heaters 38*a* to 41*a*. In the next step 515, the ECU 51 sets a failure flag HAXB to "1" indicating the an overcurrent condition exists with respect to all the heaters 38*a* to 41*a*, and then terminates the detection of the overcurrent state.

After executing the processing at step 500 in the above manner, the ECU 51 proceeds to step 600 in the flowchart in FIG. 4. At step 600, the ECU 51 determines whether driving conditions are such that allow for the detection of deterioration to the heaters 38*a* to 41*a*. This decision is made from a comparison of currently read parameters, such as NE, Q, TA, SPD and the voltage level of the battery 25 with predetermined values. In other words, following a predetermined period of time after the engine is started, certain driving conditions are assumed. For example, the vehicle speed SPD is assumed to be a value less than a predetermined value. The voltage level of the battery 25, the engine load (indicated by the parameters Q and TA), and the temperatures of the elements in the oxygen sensors 38 to 41 are presumed to fall within a predetermined range. The operation range of operating the oxygen sensors 38 to 41, for example, is chosen to prevent the oxygen sensors from being deactivated (e.g., 500° to 900° C.). When the predetermined driving conditions are satisfied, the ECU 51 proceeds to step 700 to detect the deterioration of the performances of the heaters 38*a* to 41*a*. When the predetermined driving conditions are not satisfied, the ECU 51 proceeds to step 800 directly.

At step 700, the ECU 51 determines whether the heaters 38*a* to 41*a* have suffered any deterioration in performance. The details of the processing at step 700 are illustrated in FIG. 7.

The ECU 51 first turns off all the transistors 63 to 66 for a predetermined period of time to forcibly stop energizing all the heaters 38*a* to 41*a* for the predetermined period of time. During this period, the temperatures of the heaters 38*a* to 41*a* decrease. In this embodiment, for example, the energization is stopped for about 10 seconds. Consequently, the initially high temperatures of the heaters 38*a* to 41*a* decrease to that of the element temperatures. The range over which the element temperatures decrease following a ten second pause in their deenergization is estimated to be around "50° C." This means that the element temperatures will not fall below the "400° C." needed for their proper functioning.

At step 702, the ECU 51 controls the transistors 63 to 66 to forcibly energize only the first heater 38*a*. Next at step 703, the ECU 51 determines if the detected value Ix is smaller than a predetermined value $\gamma$ ($\gamma<\beta<\alpha$). When the detected value Ix is not smaller than the predetermined value $\gamma$, the ECU 51 considers that the performance of the first heater 38*a* has not deteriorated and proceeds to step 705. When the detected value Ix is smaller than the predetermined value $\gamma$, the ECU 51 moves to step 704 and sets failure flag H1XC to "1 " indicating that the first heater 38*a* has undergone a deterioration in its performance. The ECU 51, then proceeds to step 705 where it forcibly energizes the second heater 39*a* alone by controlling the transistors 63 to 66.

At step 706, the ECU 51 determines if the detected value Ix is smaller than the predetermined value $\gamma$. When the detected value Ix is not smaller than the predetermined value $\gamma$, the ECU 51 considers that the performance of the second heater 39*a* has not deteriorated and proceeds to step 708. When the detected value Ix is smaller than the predetermined value $\gamma$, the ECU 51 moves to step 707, sets a failure flag H2XC to "1 " indicating the deterioration of the performance of the second heater 39*a*, and then proceeds to step 708 where it forcibly energizes the third heater 40*a* alone by controlling the transistors 63 to 66.

At step 709, the ECU 51 determines if the detected value Ix is smaller than the predetermined value $\gamma$. When the detected value Ix is not smaller than the predetermined value $\gamma$, the ECU 51 considers that the performance of the third heater 40*a* has not deteriorated and proceeds to step 711. When the detected value Ix is smaller than the predetermined value $\gamma$, the ECU 51 moves to step 710, sets a failure flag H3XC to "1 " indicating the deterioration has occurred in the performance of the third heater 40*a*, and then proceeds to step 711 where the ECU 51 forcibly energizes the fourth heater 41*a* alone by controlling the transistors 63 to 66.

At step 712, the ECU 51 determines if the detected value Ix is smaller than the predetermined value $\gamma$. When the detected value Ix is not smaller than the predetermined value $\gamma$, the ECU 51 considers that the fourth heater 41*a* has not suffered a deterioration in performance and terminates further performance detection. When the detected value Ix is smaller than the predetermined value $\gamma$, the ECU 51 moves to step 713 to set a failure flag H4XC to "1" indicating that the fourth heater 41*a* has experienced a deterioration in its performance. The ECU 51 then terminates further detection efforts related to deteriorated heater performance.

After executing the processing at step 700 in the above manner, the ECU 51 proceeds to step 800 in the flowchart in FIG. 4. At step 800, the ECU 51 checks whether or not a failure has occurred with the heaters 38*a* to 41*a* based on the results of the above-described determination. This checking is accomplished by determining whether or not at least one of the failure flags H1XA to H4XA, H1XB to H4XB, HAXB and H1XC to H4XC is "1". If a failure is detected, the ECU 51 proceeds to step 810 to turn on the alarm lamp 24 informing the driver of the occurrence of a failure.

At the next step 820, the ECU 51 stores a diagnostic code indicating the occurrence of a failure in the backup RAM 55. This information may include, for example, the type of failure and which of the heaters 38*a* to 41*a* are associated with the failure. This is done by reference to the failure flags HIXA to H4XA, H1XB to H4XB, HAXB or H1XC to H4XC. This data is then stored in the backup RAM 55. After executing step 820, the ECU 51 returns to step 100 to begin the above described process at the next timing cycle.

If no failure is detected at step 800, however, the ECU 51 determines whether or not there is a failure associated with the heaters 38*a* to 41*a* over the course of three complete engine operations (each operation being define as the period from engine ignition to when the engine is stopped running) at step 830. The ECU 51 determines whether or not the failure flags H1XA to H4XA, H1XB to H4XB, HAXB and H1XC to H4XC have remained at a stayed "0" level during three trips. If no failure has occurred during three trips, the ECU 51 turns off the alarm lamp 24 at step 840 and then proceeds to step 850. If a failure has occurred during the course of three complete engine operations, on the other hand, the ECU 51 proceeds directly to step 850.

At step 850, the ECU 51 determines if there is a failure associated with the heaters 38*a* to 41*a* while a warm-up has been performed 40 times. That is, the ECU 51 determines whether or not the failure flags H1XA to H4XA, H1XB to H4XB, HAXB and H1XC to H4XC have remained at "0" over the course of 40 warm-ups. If there has been no failure during 40 warm-ups, the ECU 51 moves to step 860 where the diagnose code stored in the backup RAM 55 is erased, and starts the sequence of processes from step 100 at the next timing cycle. If a failure has occurred over 40 warm-ups, the ECU 51 starts the sequence of processes from step 100 at the next timing cycle.

According to the temperature controller of this embodiment, as described above, the energization of the individual heaters 38*a* to 41*a* is controlled in accordance with the driving conditions of the engine and the temperature condition in the exhaust passage. Consequently, the amount of generated heat is properly controlled. Allowing the element temperatures of the oxygen sensors 38 through 41 also can be optimally controlled. Therefore, an improved air-fuel ratio control can be accomplished in the V shape engine system according to this embodiment.

The failure detecting apparatus according to this embodiment can detect a failure associated with the heater energizing circuits including the heaters 38*a* to 41*a*.

First, this apparatus can detect the occurrence of a disconnection associated with the heaters 38*a* to 41*a*. More specifically, all the heaters 38*a* to 41*a* are connected in parallel to one input terminal of the comparator 80 of the voltage detector 61. This allows comparator 80 to compare the voltage drop associated with the heaters 38*a* to 41*a* with the reference value VB according to this embodiment. When all the heaters 38*a* to 41*a* are determined to be energized, disconnection associated with the heaters 38*a* to 41*a* is determined based on the output of the comparator 80. If there is a disconnection respecting any one of the heaters 38*a* to 41*a*, it can be detected by comparing the heater's voltage drop with a reference value VB held in the comparator 80. Any detected voltage level change allows the ECU 51 to determine that a disconnection exists with respect to the heater.

The failure detecting apparatus according to this embodiment uses a single voltage detector 61 which includes a single comparator 80 to detect disconnection associated with a plurality of heaters 38*a* to 41*a*. This eliminates the need for providing a disconnection detecting circuit separately for each of the heaters 38*a* to 41*a*. This simplifies the overall circuit structure of the failure detecting apparatus, allowing it to be constructed with fewer components.

When a disconnection is detected respecting any one of the heaters 38*a* to 41*a*, the failure detecting apparatus of this embodiment forcibly systematically de-energizes each of the heaters 38*a* to 41*a* while energizing the others. Since this sequence is carried out with respect to each heater, a thorough and accurate diagnosis can be made of which heater has a disconnection associated with it. This is based on the output of the comparator 80.

Suppose that the energization of the first heater 38*a* is stopped and the other heaters 39*a* to 41*a* are energized. When the output of the comparator 80 is low, the ECU 51 then determines that a disconnection has occurred in association with the first heater 38*a*, which has been de-energized. At that point, the failure flag H1XA is set to "1" indicating the occurrence of disconnection associated with the first heater 38*a*. It is in this way possible to identify which of the heaters, in this case 38*a*, experienced a disconnection first.

The failure detecting apparatus of this embodiment can also detect the deterioration of the heat generating performance due to thermal deterioration of the heaters 38*a* to 41*a*. According to this embodiment, when predetermined driving conditions are satisfied, the energization of all the heaters 38*a* to 41*a* are forcibly terminated for a predetermined period of time. Next, the heaters 38*a* to 41*a* are forcibly energized one after another. The performance of the heaters 38*a* to 41*a* are then sequentially checked based on the value Ix detected by the current detector 59. It is therefore possible to determine with one of the heaters 38*a* to 41*a* has experienced a deterioration in its performance.

More specifically, the detection process based on the current driving conditions can preclude the elements in the air-fuel ratio sensors 38 to 41 from being deactivated even if the energization of the heaters 38*a* to 41*a* is forcibly interrupted during engine operation. When the driving conditions are satisfied, the energization of all the heaters 38*a* to 41*a* is forcibly stopped for a predetermined period of time regardless of the energization of the individual heaters 38*a* to 41*a*. Thereafter, the heaters 38*a* to 41*a* are forcibly and sequentially energized and the current value (detected value Is) flowing through each of the heaters 38*a* to 41*a* is compared with the predetermined value $\gamma$ to determine whether any of the heaters 38*a* to 41*a* has experienced a deterioration in its performance. In other words, after the temperatures of the heaters 38*a* to 41*a* are temporarily lowered to a certain level, the detection of the heater performance is executed.

The detected values Ix for the heaters 38*a* to 41*a* at a high temperature therefore will not be compared with the predetermined value $\gamma$. Likewise, the detected value Ix which becomes smaller due to high heater temperatures will not be compared with the predetermined value $\gamma$. It is thus unnecessary to preset the value $\gamma$ lower than required. Consequently, the range over which heater performance can be detected can be widened accordingly. This allows for an extremely high degree of precision in determining heater performance.

Further, this embodiment forcibly stops the energization of all the heaters 38*a* to 41*a* at the time the deterioration of the heater performance is determined. It is therefore possible to ensure many opportunities to detect the heater performance. In this sense, the detection precision can be further improved.

Furthermore, this embodiment sequentially determines the deteriorated performances of the heaters 38*a* to 41*a* and the determination results are set in the failure flags H1XC to H4XC. By referring to the failure flags H1XC to H4XC, therefore, deteriorated performance of any of the heaters 38*a* to 41*a* can be easily identified.

In addition, when the heaters 38*a* to 41*a* are energized, the current detector 59 detects the current values associated with the heaters 38*a* to 41*a*. This allows for the abnormal current conditions of heaters 38*a* to 41*a* to be detected based on the detected value Ix according to this embodiment. When too much current is detected with respect to any one heater, the individual heaters 38*a* to 41*a* are forcibly energized one after another. Any one of the heaters 38*a* to 41*a* utilizing too much current is specified based on the output of the operational amplifier 71.

If the output value of the operational amplifier 71 is greater than the predetermined value $\alpha$ with the first heater 38*a* forcibly energized, the failure flag H1XB is set to "1". It is therefore possible to specify the first heater 38*a* using too much current from the heaters 38*a* to 41*a* in the oxygen sensors 38 to 41. Thus, short-circuiting in the heater energizing circuit including the first heater 38*a* can easily be specified.

As described above, the failure detecting apparatus according to this embodiment can detect any disconnection, the deterioration of the heater performance and the overcurrent status associated with any one of the heater energizing circuits including the heaters 38*a* to 41*a*. In this sense, various types of failures associated with the heaters 38*a* to 41*a* can be individually detected with greater precision.

When a failure associated with any of the heaters 38*a* to 41*a* is detected, the failure detecting apparatus according to this embodiment can immediately inform the driver of the failure by turning on the alarm lamp 24. The driver can therefore cope with the failure more promptly. Data respecting the failure of the heaters 38*a* to 41*a* is stored in the backup RAM 55 piece by piece. By reading the data from the backup RAM 55 in the regular inspection of the engine, therefore, a failure associated with each one of the heaters 38*a* to 41*a*, the type of the failure and the heater that has failed can be found out specifically. This contributes to the maintenance of the engine.

Second Embodiment

Figure 8:
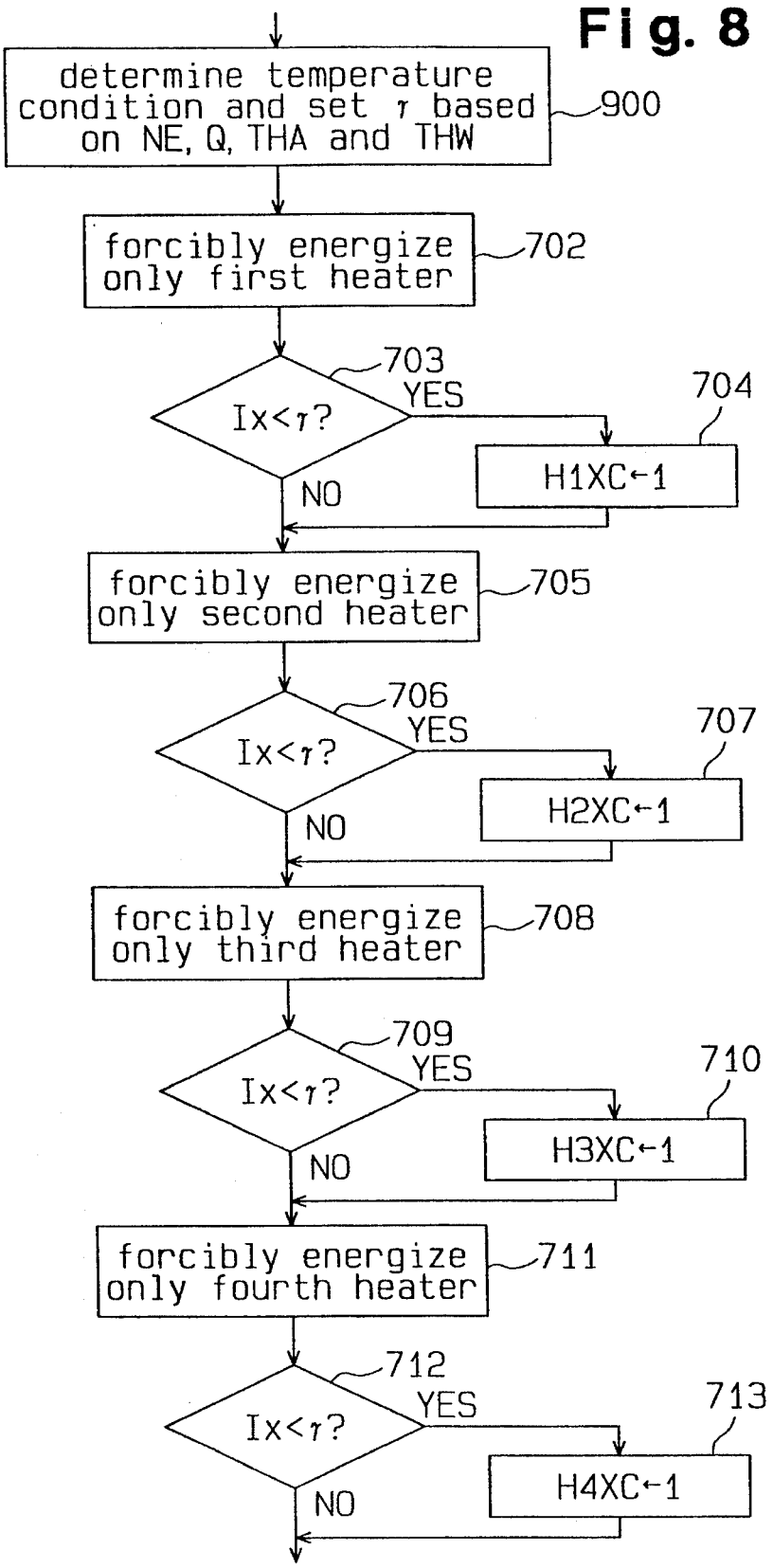
FIG. 8 is a flowchart illustrating a portion of the control routine, executed by an ECU, to detect the occurrence of a failure in a heater according to a second embodiment of the present invention.

A failure detecting apparatus in a temperature controller for an air-fuel ratio sensor according to the second embodiment will be described in detail with reference to FIG. 8. The following description of the second embodiment centers on the differences between the first and second embodiments.

According to the first embodiment, in determining the deterioration of the performance of each of the heaters 38*a* to 41*a*, when predetermined driving conditions are satisfied, the energization of the heaters 38*a* to 41*a* is forcibly interrupted stopped for a predetermined period of time, the heaters 38*a* to 41*a* are then energized one after another and the detected values Ix for the heaters 38*a* to 41*a* are compared with the predetermined value γ.

According to the second embodiment, the predetermined value γ to be compared with the detected value Ix is set in accordance with the temperature condition of each of the oxygen sensor 38 to 41 without forcing the termination of the heaters 38*a* to 41*a*. FIG. 8 illustrates the contents of the process for detecting the deterioration of the heater performance according to this embodiment, and is similar to the flowchart given in FIG. 7.

In this flowchart, unlike the one in the first embodiment, the ECU 51 estimates the temperature condition for each of the heaters 38*a* to 41*a* based on various parameters NE, Q, THA and THW which reflect the driving conditions of the engine, and sets the predetermined value γ in accordance with the temperature condition at step 900 before executing a sequence of steps 702 to 713.

Thereafter, the ECU 51 compares the predetermined value γ with the detected value Ix at steps 702 to 713 to determine the deterioration of the performance of each of the heaters 38*a* to 41*a*. The ECU 51 then sets failure flags H1XC to H4XC to reflect the heater's performance as per the first embodiment.

The failure detecting apparatus according to the second embodiment sets the predetermined value γ, which is to be compared with the detected value Is, in accordance with the temperature condition of each of the heaters 38*a* to 41*a*. Even if the detected value Ix changes due to a difference in occasional temperature condition, the detected value Ix is compared with the proper predetermined value γ. The deteriorated performance can therefore be determined according to a difference in temperature conditions. This type of detection process can be performed with a relatively high degree of precision.

Further, according to this embodiment, since the energization of the heaters 38*a* to 41*a* need not be stopped over a predetermined period of time before the deterioration of the heater performance is determined, determination of the heater performance can be made in a relatively short period of time. The other function and advantages of this embodiment are basically the same as those of the first embodiment.

Although only two embodiments of the present invention have been described herein, it should be apparent to those skilled in the art that the present invention may be embodied in many other specific forms without departing from the spirit or scope of the invention. Particularly, it should be understood that the present invention may be embodied in the following manners.

In the first embodiment, a total of four oxygen sensors 38 to 41 are provided for the two catalytic converters 14L and 14R associated with the left and right banks 2 and 3 of a V shape engine. The present invention may be also be used in the case where a total of two or more oxygen sensors are provided at the upstream side and downstream side of a single catalytic converter disposed along a single exhaust passage for an in-line type engine.

Although the first embodiment is designed so that the voltage drop levels associated with the heaters 38*a* to 41*a* are compared with the reference value VB by the comparator 80 in the voltage detector 60, the value of the current flowing through each heater may be compared with the reference value by the comparator or other functionally equivalent circuit.

The first embodiment is provided with the voltage detector 61 including the comparator 80 and the current detector 59 so that a failure associated with any of the heaters 38*a* to 41*a* is determined based on both the voltage drop level and current value associated with each heater. Alternatively, only a voltage detector including a comparator may be provided so that a failure associated with any of the heaters 38*a* to 41*a* is determined based on only the level of the voltage drop in each heater.

In the above-described embodiments, the value Ix detected by the current detector 59 is compared with the predetermined value γ to determine the deterioration in the performance of each of the heaters 38*a* to 41*a*. Alternatively, the voltage drop level associated with each of the heaters 38*a* to 41*a* may be compared with the reference value VB in the comparator 80 of the voltage detector 61. Deterioration in the performance of each heater may be determined based on the comparison result. In this case, the reference value VB used in the comparison may be set based on an value determined by the CPU 52. This value may be altered in accordance with the temperature conditions of the heaters 38*a* to 41*a*.

The comparator may further compare the reference value with the value of the current flowing through each heater, rather than the voltage drop level.

Although the above embodiments are adapted particularly for use in an engine system equipped with a plurality of oxygen sensors 38 to 41 to detect a failure associated with any one of a plurality of heaters 38*a* to 41*a*, the present invention may of course be embodied in an engine system equipped with a single oxygen sensor to detect a failure associated with a single heater.

Therefore, the present examples and embodiments are to be considered as illustrative and not restrictive and the invention is not to be limited to the details given herein, but may be modified within the scope of the appended claims.

What is claimed is:

1. A failure detecting apparatus in a temperature controller having an electric heater which is provided in an air-fuel ratio sensor disposed in an exhaust passage in an engine, said sensor being arranged to be activated when being heated up to a predetermined temperature, wherein said apparatus is arranged to adjust an amount of heat generated by said heater to control a temperature of said sensor by selectively energizing and deenergizing said heater with an electric power from a power supply in accordance with driving conditions of the engine and a temperature condition in the exhaust passage, said apparatus comprising:

first detecting means for detecting a driving status of the engine;

second detecting means for detecting a selected one from a group consisting of a current magnitude in the heater and a voltage value associated with said heater;

control means for storing data indicative of predetermined driving conditions of the engine under which the temperature controller is to be diagnosed, said control means forcibly deenergizing the heater for a predetermined period of time when the driving status detected by the first detecting means meets with the predetermined driving conditions; and failure determining means for energizing said heater after said predetermined period of time when said heater has been forcibly deenergized by said control means, and determining an occurrence of a failure associated with said heater based on a detection result of said second detecting means.

2. The failure detecting apparatus according to claim 1, wherein said predetermined driving conditions include a condition under which said air-fuel ratio sensor is kept to be activated when said heater is forcibly deenergized, and a condition under which a voltage value of the power supply falls within a predetermined effective range.

3. The failure detecting apparatus according to claim 1, wherein said first detecting means includes a sensor for detecting a rotational speed of said engine and a sensor for detecting an amount of intake air in said engine.

4. The failure detecting apparatus according to claim 1, wherein said second detecting means includes a current detector for detecting a selected one from a group consisting of a current magnitude in said heater and a voltage detector for detecting a voltage value associated with said heater.

5. The failure detecting apparatus according to claim 1 further comprising an electronic control unit having an input signal processor, an arithmetic logic unit and an output signal circuit, said electronic control unit constituting said first control means and said failure determining means.

6. A failure detecting apparatus in a temperature controller having an electric heater which is provided in an air-fuel ratio sensor disposed in an exhaust passage in an engine, said sensor being arranged to be activated when being heated up to a predetermined temperature, wherein said apparatus is arranged to adjust an amount of heat generated by said heater to control a temperature of said sensor by selectively energizing and deenergizing said heater with an electric power from a power supply in accordance with a driving condition of the engine and a temperature condition in the exhaust passage, said apparatus comprising:

first detecting means for detecting a driving status of the engine;

second detecting means for detecting a selected one from a group consisting of a current magnitude in the heater and a voltage value associated with said heater;

computing means for computing a temperature of the heater based on the driving status of the engine;

setting means for setting a reference value to be compared with a detection result of said second detecting means, in accordance with the computed temperature of said heater; and failure determining means storing data indicative of predetermined driving conditions of the engine under which the temperature controller is to be diagnosed, for comparing said detection result of said second detecting means to determine an occurrence of a failure associated with said heater, when determining that the driving status of the engine meets with the predetermined driving conditions.

7. The failure detecting apparatus according to claim 6, wherein said predetermined driving conditions include a condition that a voltage value of said power supply falls within a predetermined effective range.

8. The failure detecting apparatus according to claim 6, wherein said first detecting means includes a sensor for detecting a rotational speed of said engine and a sensor for detecting an amount of intake air in said engine.

9. The failure detecting apparatus according to claim 6, wherein said second detecting means includes a current detector for detecting a selected one from a group consisting of a current magnitude in said heater and a voltage detector for detecting a voltage value associated with said heater.

10. The failure detecting apparatus according to claim 6 further including an electronic control unit having an input signal processor, an arithmetic logic unit and an output signal circuit, said electronic control unit constituting said computing means, said setting means and said failure determining means.

11. A failure detecting apparatus in a temperature controller having electric heaters which are respectively provided in air-fuel ratio sensors disposed in an exhaust passage in an engine, each sensor being arranged to be activated when being heated up to a predetermined temperature, wherein said apparatus is arranged to adjust an amount of heat generated by each heater to control a temperature of the associated sensor by selectively energizing and deenergizing each heater with an electric power from a power supply in accordance with driving conditions of the engine and a temperature condition in the exhaust passage, said apparatus comprising:

first detecting means for detecting a driving status of said engine;

second detecting means for detecting a selected one from a group consisting of a current magnitude in each heater and a voltage value associated with each heater;

control means storing data indicative of predetermined driving conditions of the engine under which the temperature controller is to be diagnosed, said control means forcibly deenergizing the heaters for a predetermined period of time when the driving status detected by the first detecting means meets with the predetermined driving conditions;

failure determining means for sequentially energizing said heaters after said predetermined period of time when said all of said heaters have been forcibly deenergized by said control means, and determining an occurrence of a failure associated with each heater based on a detection result of said second detecting means.

12. The failure detecting apparatus according to claim 11, wherein said third detecting means includes a comparator for comparing said detection result of the second detecting means with a predetermined reference value, said comparator having a first input terminal for receiving said reference value and a second input terminal connected in parallel to all of said heaters.

13. The failure detecting apparatus according to claim 12, wherein said failure determining means determines an occurrence of a failure associated with each heater based on an output of said comparator obtained by comparing said detection result of the second detecting means with said reference value, when determining that all of said heaters are energized.

14. The failure detecting apparatus according to claim 13 further comprising:

second control means for forcibly deenergizing one of said heaters and forcibly energizing the other heaters, said second control means executing the sequential deenergization and energization controls for all of said heaters, when said failure determining means determines a failure in said heaters; and specifying means for specifying the failed heater based on said output of said comparator when said deenergization and energization controls on said heaters are sequentially executed by said second control means.

15. The failure detecting apparatus according to claim 12, wherein said reference value used in said comparator is set in accordance with a number of energized heaters.

16. The failure detecting apparatus according to claim 12, wherein said predetermined driving conditions include a condition under which said air-fuel ratio sensors are kept to be activated when said heaters are forcibly deenergized, and a condition under which a voltage value of said power supply falls within a predetermined effective range.

17. The failure detecting apparatus according to claim 12, wherein said first detecting means includes a sensor for detecting a rotational speed of said engine and a sensor for detecting an amount of intake air in said engine.

18. The failure detecting apparatus according to claim 12, wherein said second detecting means includes a selected one from a group consisting of a current detector for detecting a current magnitude in each heater and a voltage detector for detecting a voltage value associated with each heater.

19. The failure detecting apparatus according to claim 12 further including an electronic control unit having an input signal processor, an arithmetic logic unit and an output signal circuit, said electronic control unit constituting said second control means and said failure determining means.

* * * * *